US005628163A

United States Patent [19]

Keopple et al.

[11] Patent Number: 5,628,163

[45] Date of Patent: May 13, 1997

[54] MODULAR CUTTING HEAD APPARATUS FOR HIGH SPEED WRAPPING MACHINE

[75] Inventors: Norbert P. Keopple; Stanley D. Denker, both of New Richmond, Wis.

[73] Assignee: Doboy Packaging Machinery, Inc., New Richmond, Wis.

[21] Appl. No.: 668,320

[22] Filed: Jun. 26, 1996

Related U.S. Application Data

[63] Continuation of Ser. No. 509,855, Aug. 1, 1995, abandoned.

[51] Int. Cl.[6] ..... B65B 7/00

[52] U.S. Cl. ..... 53/374.4; 83/348; 53/374.5

[58] Field of Search ..... 53/371.4, 374.4, 53/374.5, 550; 83/348; 74/665 GE

[56] References Cited

U.S. PATENT DOCUMENTS

| | | | |
|---|---|---|---|
| 842,934 | 2/1907 | Bolton et al. . | |
| 2,216,321 | 10/1940 | O'Brien . | |
| 2,352,301 | 6/1944 | Welles | 74/665 GE |
| 2,522,148 | 9/1950 | Traxler . | |
| 2,613,546 | 10/1952 | Jorgensen . | |
| 3,229,442 | 1/1966 | Gram | 53/550 |
| 3,282,121 | 11/1966 | Wehner . | |
| 3,524,301 | 8/1970 | Zimmerman | 53/374.4 |
| 3,546,849 | 12/1970 | Zimmerman | 53/550 |
| 3,685,098 | 8/1972 | Lapeyre . | |
| 3,789,684 | 2/1974 | Freier, Jr. . | |
| 3,821,906 | 7/1974 | Berg . | |
| 3,894,646 | 7/1975 | Head et al. | 214/522 |
| 4,887,707 | 12/1989 | Harms . | |
| 5,113,635 | 5/1992 | Takai et al. | 53/550 |
| 5,121,648 | 6/1992 | Seiler . | |
| 5,125,488 | 6/1992 | Green et al. . | |
| 5,177,932 | 1/1993 | Schmetzer | 53/550 |
| 5,347,791 | 9/1994 | Ginzl et al. | 53/550 |

FOREIGN PATENT DOCUMENTS

| | | | |
|---|---|---|---|
| 131334 | 6/1978 | Germany | 74/665 GE |

*Primary Examiner*—John Sipos
*Assistant Examiner*—Gene L. Kim
*Attorney, Agent, or Firm*—Haugen and Nikolai, P.A.

[57] ABSTRACT

A cutting head apparatus for use in a high speed horizontal wrapper. The apparatus has two modular cutting heads each with a cutting shaft. The cutting shafts cooperate for cutting and sealing wrapping material between the products being wrapped. The cutting shafts are journaled for rotation in bearing blocks located on opposing ends of the shafts. Each modular cutting head can be mounted in at least two operative positions on a cutting head support frame. The bearing blocks of the modular cutting heads are mounted on the cutting head apparatus to permit movement of the shafts away from the cutting area in the event a product becomes misaligned and the cutting blade and anvil contact the misaligned product.

13 Claims, 6 Drawing Sheets

MODULAR CUTTING HEAD APPARATUS FOR HIGH SPEED WRAPPING MACHINE

This is a continuation of application Ser. No. 08/509,855, filed on Aug. 1, 1995, now abandoned.

FIELD OF THE INVENTION

The present invention relates to a high speed wrapping and packaging machinery and more particularly to a modular cutting head apparatus used in the high speed wrapping and packaging machine.

BACKGROUND OF THE INVENTION

In a high speed wrapping and packaging machine such as a horizontal wrapping machine, a continuous film of packaging material is supplied from a roll and drawn past a film former which shapes the film into a continuous tube of packaging material. Products to be wrapped are supplied through the film former and into the tube of packaging material such that products are spaced apart from one another in the packaging material tube. The packaging material tube is then cut and sealed as each product, carried within the tube, passes a sealing and cutting station. As the products advance through the sealing and cutting station, a pair of opposed cut/seal heads are rotated into engagement with the packaging film tube at a location on the film tube between each successive pair of products. The cut/seal heads typically carry a cutting blade along with heated crimpers on one cutting head shaft extending transversely to the packaging film tube and an anvil along with heated crimpers on the other cutting head shaft which cooperates with the cutting blade and crimpers for performing the cutting and sealing operation thereby forming discrete packages.

A variety of product sizes can be packaged with a single wrapper by changing the type of cutting head shaft arrangement found at the cutting and sealing station. A cutting head is typically configured with one, two or four crimpers. The cutting head shaft can also vary in diameter. It is very time consuming to change the cutting heads on a wrapper. Three to five hours are often spent changing the head configuration on conventional wrappers. Thus, a cutting head arrangement that allows for a quick change-over of the wrapper cutting head configuration is desirable.

Wrappers additionally have problems that arise when product becomes misoriented as it is packaged. The wrapping machine is designed to obtain the proper orientation of each product relative to a cut length of film, the cut length being the amount of film used in each package. The cutting blade and anvil should come together at the proper point between the products in the film tube. Any shifting of the product position relative to the packaging film will result in a misorientation condition. A product may lose its necessary orientation as it is introduced into the packaging film tube and sealing station and a product may also lose proper orientation if any slippage occurs within the packaging film tube. When a product falls out of registration with the synchronized operation of the cutting and sealing heads the cutting blade and anvil come together with the product sandwiched therebetween. The product is destroyed and furthermore, the packaging film material is lifted and pulled out from between the finwheels used to create the longitudinal seal in the wrapper.

Premature failure of the two cutting heads also results when the cutting heads attempt to cut through both product and packaging film material. Furthermore, the packaging machine must be shut down to clear the damaged product and to reroute the packaging film material through the film former and between the finwheels. This detracts from the production rate for the machine, is time consuming and disruptive to the high speed packaging production runs.

To address the problem of misoriented products, a prior art cutting head assembly was developed in which the upper cutting head was mounted to deflect away from the cutting area instead of attempting to cut and seal the misoriented product. Thus, if the cutting blade and anvil contacted a misoriented product in the packaging film material instead of just the packaging film material, the upper cutting shaft is deflected away from the cutting area instead of attempting to cut and seal the product. As a result, the cutting heads did not experience the premature failure of the non-deflecting prior art cutting head arrangements. However, this prior art cutting head arrangement does not resolve the problem of the packaging film material being pulled out of line in the finwheels and film former. In this prior art arrangement, the product and film must ride up over the non-deflecting cutting shaft surface causing the packaging film material to be pulled out of line in the finwheels and film former. Again, such an event requires the shut down of the packaging machine while the fault condition is cleared, thus detracting from the production rate for the machine. Additionally, this prior art cutting head arrangement still requires several hours of machine down time to replace the cutting head configuration.

The present invention provides a solution that addresses the need for a quick head configuration change-over, the problem of premature failure of the cutting heads and the problem of the packaging film material being pulled out of line in the finwheels and film former. A modular cut/seal shaft arrangement is used. Each cut/seal head shaft end is journaled in a bearing block. The bearing blocks slide in channels comprising the cut/seal head frame assembly, thus allowing the cut/seal heads to be quickly removed and replaced with a different head configuration. Additionally, both cut/seal shafts are mounted so that when products become misaligned and are caught between the cutting blade and anvil, both cut/seal head shafts are deflected away from the cutting area. The cutting blade and anvil do not attempt to cut through the product and the packaging film material is not pulled out of the finwheels. Wrapping and packaging production can continue without shutting down the packaging machine for clearing the cutting area of the damaged product and packaging film material and for rerouting the packaging film through the finwheels.

The use of two driven shafts in which each driven shaft incorporates two u-joints enables the deflection of the shafts away from the cutting area. Furthermore, the use of the u-joint driven shafts spreads the torsional forces throughout the cutting head assembly.

It is accordingly a principal object of the present invention to provide an improved apparatus and method for a cut/seal head apparatus used in a high speed packaging machine.

A further object of the present invention is to provide a modular cut/seal shaft arrangement that provides a quick change over to a different cutting head configuration, allowing quick set-up when different products to be packaged are run on the wrapper.

Another object of the present invention is to provide a modular cut/seal head apparatus which allows the user to quickly select and position the modular cut/seal head shafts in the cut/seal head frame at the desired operating position.

A still further object of the invention is to provide a cutting head apparatus which responds to a misaligned product without causing the packaging film material to become dislodged from the finwheels or the film former, thus minimizing the loss of packaging film material.

Still another object of the present invention is to provide a cutting head apparatus which responds to a misaligned product without causing premature wear and failure of the cutting head apparatus.

Yet another object of the present invention is to provide a cutting head apparatus which responds to misaligned products without causing the product to become damaged from the cutting operation of the cutting head apparatus.

A still further object of the present invention is to provide a cutting head apparatus which incorporates two cutting heads shafts that will deflect away from the product in the cutting area when the two opposed rotating cutting shafts contact a misaligned product therebetween, thereby preserving the product integrity, preventing packaging film material from becoming dislodged or pulled from the finwheels and film former and preventing waste of the packaging film material.

SUMMARY OF THE PRESENT INVENTION

To achieve these and other objects and advantages, there is provided a modular cutting head apparatus for use on a high speed wrapping and packaging machine. The modular cut/seal head apparatus includes a frame in which two opposed rotating cut/seal head shafts are mounted transverse to the direction of travel of the packaging film and the material products being packaged. One cut/seal shaft preferably contains a cutting blade and crimpers and the other cut/seal/head shaft contains an anvil and crimpers which cooperates with the cutting blade and crimpers for cutting and sealing the packaging film in a direction transverse to the direction of product flow.

Each cut/seal head shaft end is journaled for rotation in a bearing block, forming a modular cut/seal head shaft unit. Each modular cut/seal shaft unit has at least two positions in the frame and is readily removed from the frame to be reinserted for a different spacing between the cut/seal head shafts or to be replaced by another having a different crimper configuration and/or shaft diameter. The cutting shafts' axes of rotation are offset from the center axes of the bearing blocks. This enables the modular cut/seal head shaft and bearing blocks to be removed from the frame, rotated 180 degrees and reinserted in the frame to achieve a different spacing between the cutting shafts.

The bearing blocks of each modular cutting shaft unit are mounted in the frame to allow deflection in a direction away from the cutting area should the cutting blade and anvil encounter a misaligned product. Thus, the modular cut/seal head shaft units may move within the frame in a direction away from and towards the cutting area. A compression spring or comparable yieldably resilient member such as an air cylinder is coupled between the bearing blocks of the modular cutting unit and frame. Thus, the deflection of the cutting shafts is controlled and damped. A wedge member is located on the frame between the bearing blocks of the opposing modular cutting head units to serve as a stop. The bearing blocks are preferably held in tension against the wedge member, enabling the shaft to be properly positioned for the cutting and sealing operation and allowing proper repositioning of the shafts after they have been deflected away from the cutting area.

Two driven shafts which operably connect the cut/seal head shafts to a drive assembly each contain two u-joints. A first u-joint is located between the drive assembly and the driven shaft. A second u-joint is located adjacent to the cut/seal shaft and the driven shaft. The use of the u-joints on the driven shafts allows both cut/seal head shafts to deflect without disengaging or otherwise disrupting the drive assembly. The u-joints also results in the torsional forces spreading evenly throughout the cut/seal head assembly.

The drive assembly of the preferred embodiment incorporates a twisted timing belt apparatus. A pair of small diameter pulleys are located on a drive assembly frame. A pair of large diameter pulleys, each on a separate axis that extends perpendicular to the axis of the small diameter pulleys, are also located on the drive assembly frame. A continuous timing belt having regularly spaced teeth thereon is deployed over the four pulleys. In particular, each of the drive pulleys and idler pulleys have 180 degrees of belt wrap around it so that a maximum number of teeth always engage each of the pulleys. This drive arrangement allows the belt to be removed or replaced without tools. The drive is reversed by just reversing the direction of the motor drive shaft.

BRIEF DESCRIPTION OF THE DRAWINGS

The foregoing features and advantages of the invention will become apparent to those skilled in the art from the following detailed description of a preferred embodiment, especially when considered in conjunction with the accompanying drawings in which.

DETAILED DESCRIPTION OF THE PREFERRED EMBODIMENT

The present invention relates to modular cut/seal head shafts located at the cutting and sealing station of a high speed wrapper. These modular cut/seal head shafts also address the situation when products become misoriented within the packaging tube during the operation of the high speed packaging and wrapping machine. The packaging and wrapping operation which incorporates the present invention will be discussed generally first and then the specifics of the present invention will be detailed.

Figure 1:
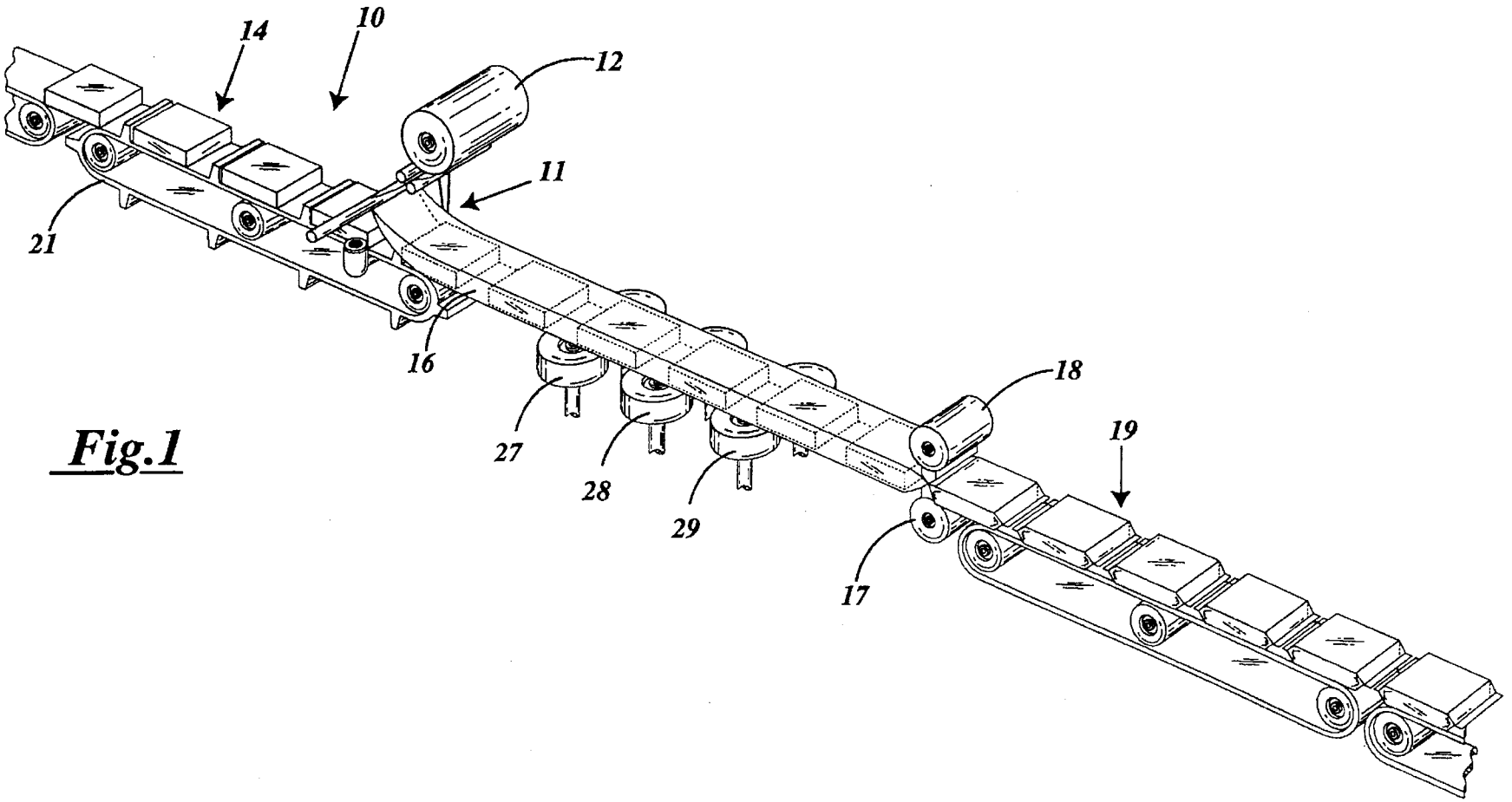
FIG. 1 is a schematic perspective view of a high speed wrapping and packaging machine incorporating the present invention.

Referring first to FIG. 1, there is shown a high speed packaging and wrapping machine 10, including a film former 11 for shaping a continuous film of a packaging material which is drawn past the film former 11 from a roll of sheet film 12, which may be printed or unprinted. Products 14 to be wrapped are fed into the film former 11 and carried within the packaging film tube 16 created by the passage of the film material through the film former 11. The packaging film tube 16 is shown as being formed into a generally rectangular shape, having its two edge portions formed into downwardly extending strips (not shown) which pass between a suitable drive arrangement such as a finwheel drive assembly or a band sealer. In FIG. 1, a series of three finwheel pairs 27, 28, and 29 are illustrated. Each finwheel in each pair of finwheels rotates in opposite direction, firmly gripping the downwardly extending adjacent packaging film edges therebetween and thus moving the packaging film tube 16 towards modular cutting/sealing head units 17 and 18. The middle pair 28 of the finwheels is preferably heated to effect sealing of the edges of the packaging film tube 16 together in a continuous longitudinal seal.

The now sealed packaging film tube 16 containing the spaced apart products 14 continues to be advanced by the finwheel drive assemblies through the cutting and sealing area. The modular cutting head units 17 and 18 contain a blade and anvil crimper arrangement which rotate in opposite directions to meet and engage the packaging film tube 16 between each product as the products move through the cutting and sealing station. The cutting head shafts move at substantially the same linear rate as the film when the cutting blade and anvil engage the film. The blade and anvil on the modular cutting head units 17 and 18 coact to compress the film tube together into a flattened condition. At least one of the modular cutting head units 17 and 18 is heated and the compressed plastic film tube 16 becomes transversely sealed as it is cut, thereby enclosing each product in an enclosed, sealed package 19. The resulting individual packages 19 are carried from the cutting and sealing station to a suitable receiving apparatus which may, for example, lead to a cartoning machine where individual packages are placed in boxes.

Figure 2:
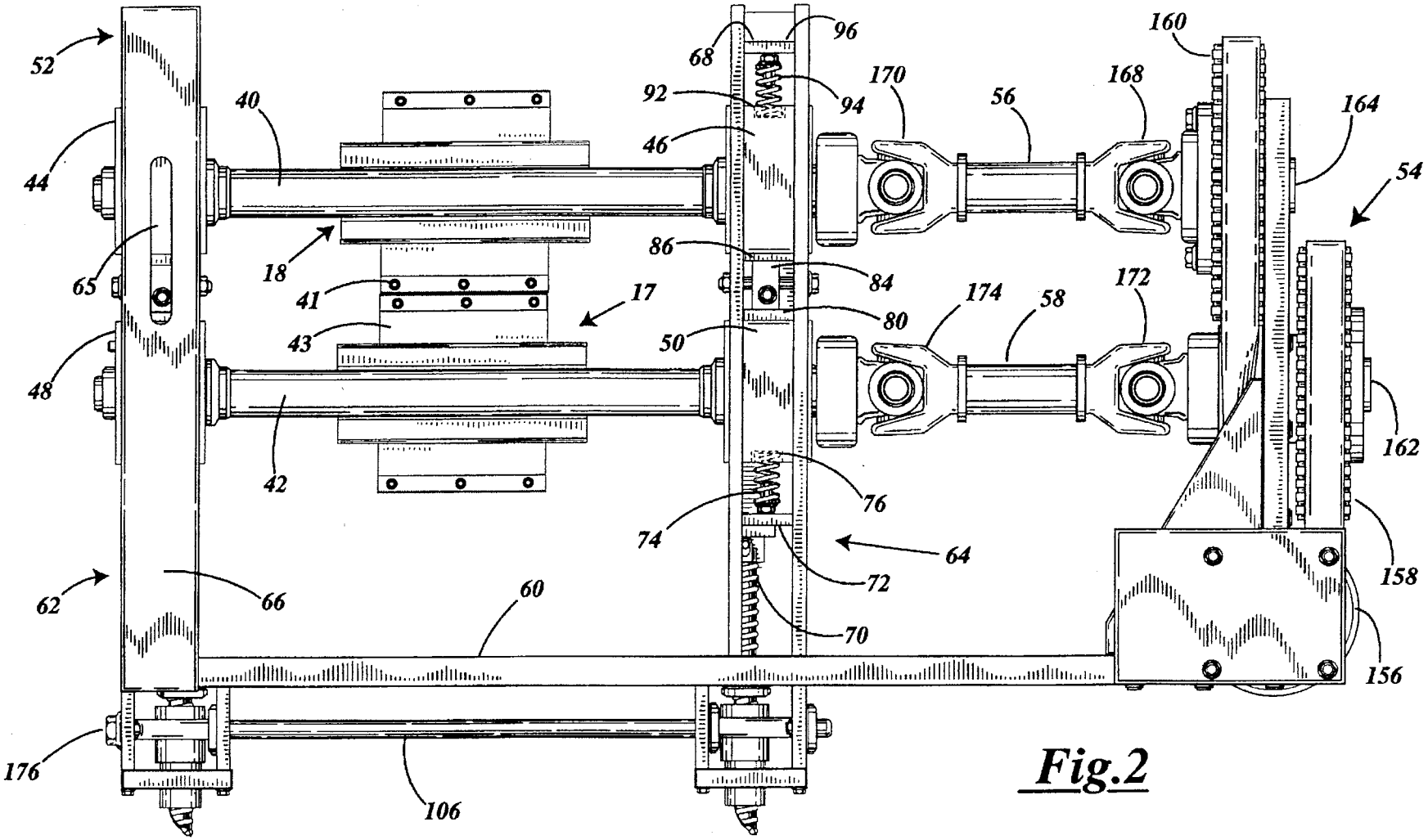
FIG. 2 is a front view of the cut/seal head apparatus and associated drive incorporating the present invention, with the view partially sectioned away to reveal details of the present invention.
Figure 3:
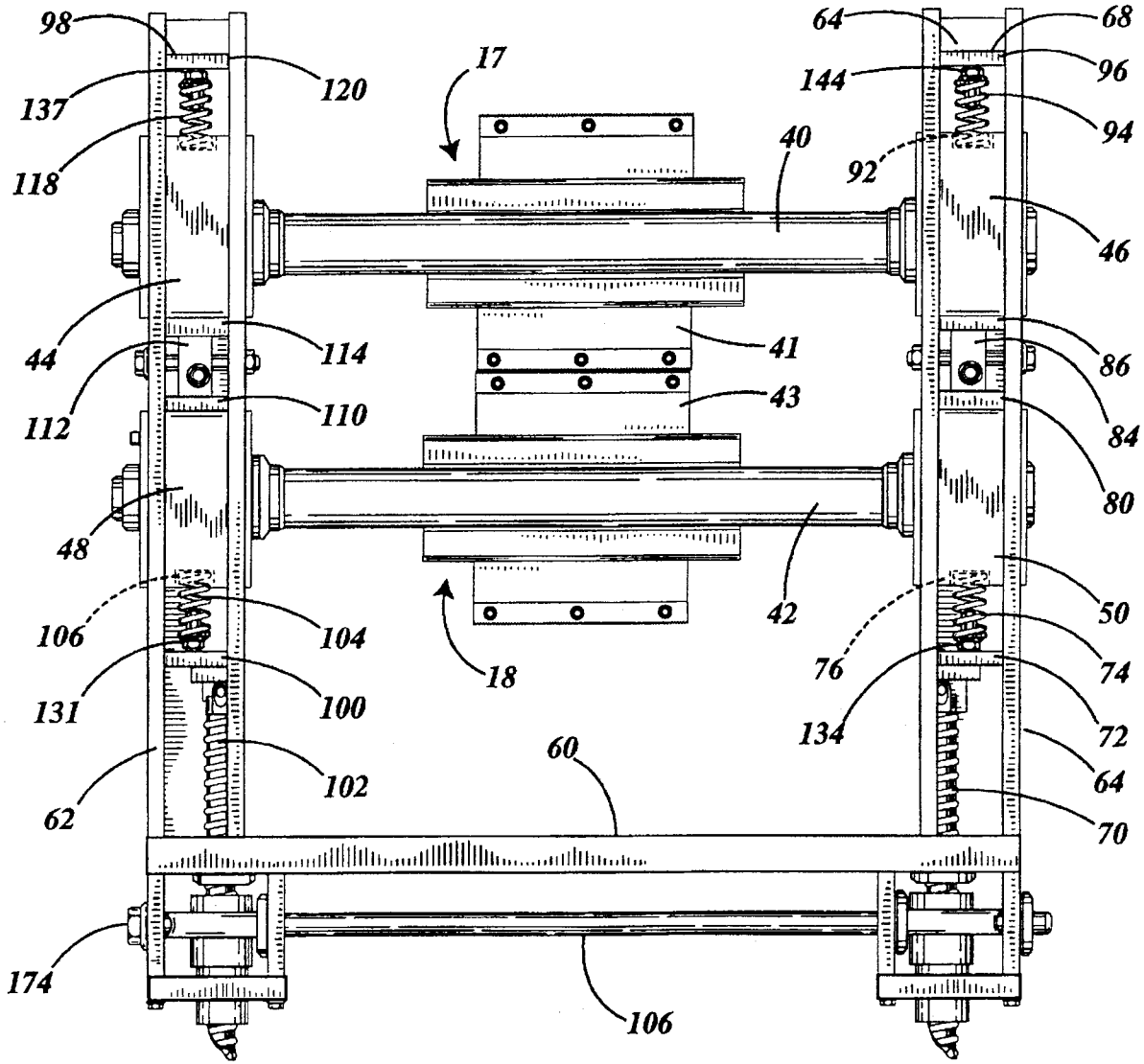
FIG. 3 is a front view of the cut/seal head apparatus with the view partially sectioned to reveal details of the present invention.
Figure 4:
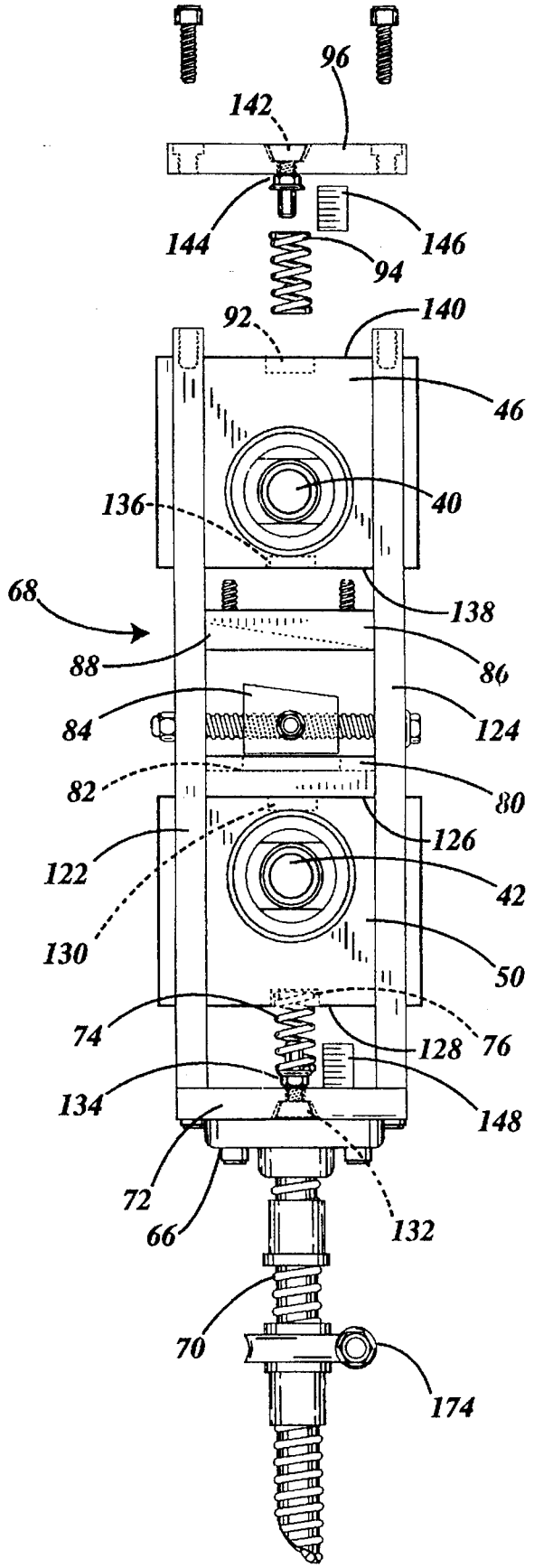
FIG. 4 is a partially sectioned and exploded end view of one carriage of the present invention.
Figure 5A:
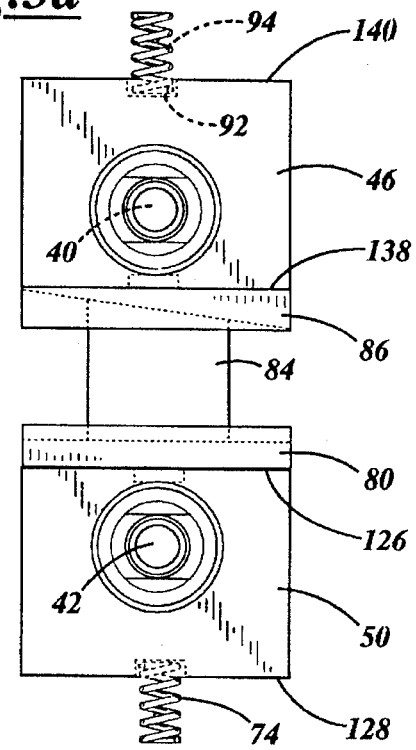
FIGS. 5*a–c* are schematics of the various cut/seal head shaft arrangements.
Figure 5B:
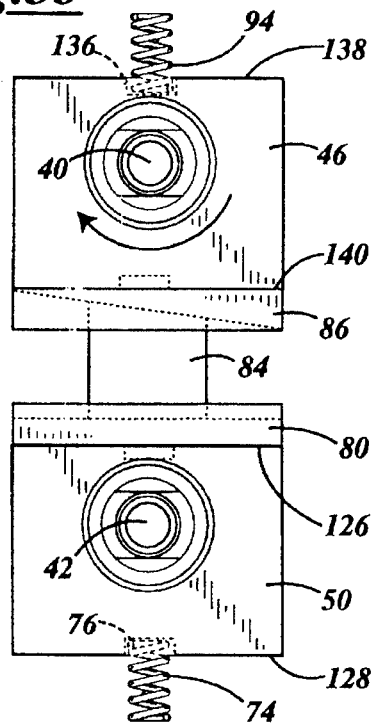
Figure 5C:
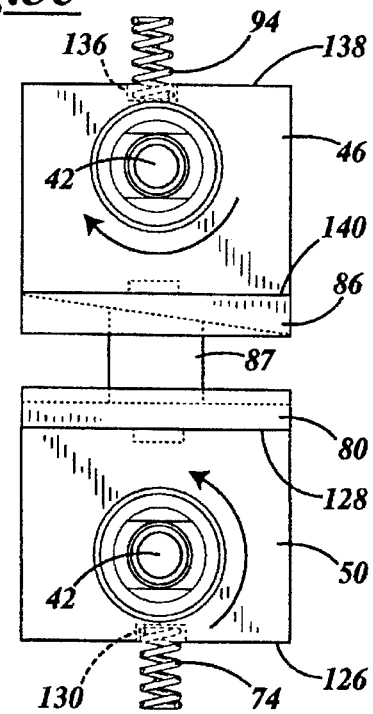

With reference now to FIGS. 2, 3 and 4, the cut/seal head apparatus for the high speed wrapping machine 10 is illustrated. The cut/seal head apparatus contains modular cutting head units 17 and 18 containing opposing cutting/sealing head shafts 40 and 42. The cutting head crimper arrangement may vary according to the packaging needs, but typically includes a cutting blade 41 and cooperating anvil 43. The cutting/sealing head shaft 40 is journaled for rotation in bearing blocks 44 and 46 forming a first modular cutting/sealing head shaft unit and shaft 42 is journaled for rotation in bearing blocks 48 and 50 forming a second modular cutting/sealing shaft unit. Each modular cutting head shaft unit is slidably mounted in a support frame 52. Two u-joint driven shafts 56 and 58 couple the two shafts 40 and 42 to a twisted timing belt drive assembly 54.

The cutting head support frame 52 includes a platform member 60, sideframe 62 and sideframe 64. The sideframes 62 and 64 are located opposite each other in parallel spaced apart relationship. The products 14 to be packaged and enclosed in the packaging film material passes through the sideframes 62 and 64 between cutting/sealing head shafts 40 and 42.

As shown in FIG. 2, sideframe 62 has a front panel 66 with a window 65 for access to a selectively adjustable carriage (not shown) in which bearing blocks 44 and 48 are mounted for movement therein. The front panel of sideframe 64 and a wall of a selectively adjustable carriage 68 located within the sideframe 64 are removed in FIGS. 2 and 3 to show certain components of selectively adjustable carriage 68. A height adjustment screw 70 is mounted to an end plate 72 of carriage 68. A spring 74 is also secured to the end plate 72 and extends into counterbore 76 located on bearing block 50. A removable wedge retaining plate 80 is secured on the opposite side of bearing block 50. This plate 80 has a recess 82, shown in FIG. 4, for receiving a portion of wedge member 84 secured to the carriage between the two bearing blocks 46 and 50. Bearing block 46 also has a removable wedge retaining plate 86. It has an angled recess 88, shown in FIG. 4, for receiving an angled portion of the wedge member 84. Spring 94, mounted to end plate 96 of carriage 68, extends into counterbore 92 located on bearing block 46.

Sideframe 62, shown in FIG. 3 with its front panel removed, supports carriage 98. Carriage 98 has an end plate 100 to which a height adjustment screw 102 is secured. The height adjustment screw 102 is coupled to a shaft 106 which is also coupled to the height adjustment screw 70 of sideframe 64. A spring 104 is mounted to end plate 100 and extends into spring receiving counterbore 106 located on bearing block 48. The bearing block 48 additionally has a removable plate 110 with a recess (not shown) for receiving a portion of a wedge member 112.

Bearing block 44 likewise has a removable plate 114 with a recess (not shown) for receiving an angled portion of the wedge member 112 and a spring receiving counterbore 115. Spring 118 secured to end plate 120 of the carriage 98 extends into the counterbore 115.

Turning now to FIG. 4, the carriages, which are identical in structure, will be described in greater detail by reference to carriage 68 of side frame 64. Cutting/sealing shaft 42 is journaled for rotation in bearing block 50. As shown in FIG. 4, cutting/sealing shaft 42 has an axis of rotation offset from the center axis of bearing block 50. As a result, the spacing between the cutting/sealing shaft 42 and a first end 126 is less than the spacing between the cutting/sealing shaft 42 and a second end 128. Bearing block 50 contains two spring receiving counterbores. Counterbore 130 is located on first end 126 and counterbore 76 is located on second end 128. Wedge retaining plate 80 conventionally mounts to either the first or second end of bearing block 50 and is readily removed from one end and mounted to the other end. Spring 74 mounts to the carriage end plate 72 with an adjustment screw 132 and nut 134. Carriage end plate 72 is fastened to the walls 122 and 124 of the carriage. A wedge member located on the other side of bearing block from the carriage end plate 72 is also secured to carriage walls 122 and 124. Bearing block 50 is mounted to slide or "float" in a longitudinal direction within walls 122 and 124 between wedge member 84 and end plate 72.

The upper end of the carriage is shown in exploded view in FIG. 4 so the construction may be shown. Shaft 40 is journaled for rotation in bearing block 46. Like bearing block 50, the axis of rotation of shaft 40 is offset from the central axis of block 50. End 140 is farther from the axis of rotation of shaft 40 than end 138. A spring receiving counterbore 136 is located at bearing block end 138 and another spring receiving counterbore 92 is located at bearing block end 140. Spring 94 is secured to end plate 96 by adjustment screw 142 and nut 144. It extends into either counterbore 130 or 76 depending upon the orientation of block 50. Wedge retaining plate 86 is conventionally secured to the block 46 in a manner that allows it to be removed or replaced. The plate 86 may be mounted to either end 138 or 140 of bearing block 46. Wedge retaining plate 86 has an angled recess 88 which receives the angled edge of wedge member 84. Bearing block 46 is mounted in the carriage in a manner which allows it to slide or "float" between wedge member 84 and end plate 96.

The two carriage end plates 72 and 96 include scales 146 and 148. Scales 146 and 148 are used for comparing the tension of the spring 74 with the tension of spring 94. The springs 74 and 94 are partially tensioned and provide a damping effect to the bearing blocks 46 and 50. Those skilled in the art will appreciate that any yieldably resilient members can be used in place of the compression springs such as air cylinders. As will be explained later, it is preferable that the spring tension in the two springs be identical.

Figure 6:
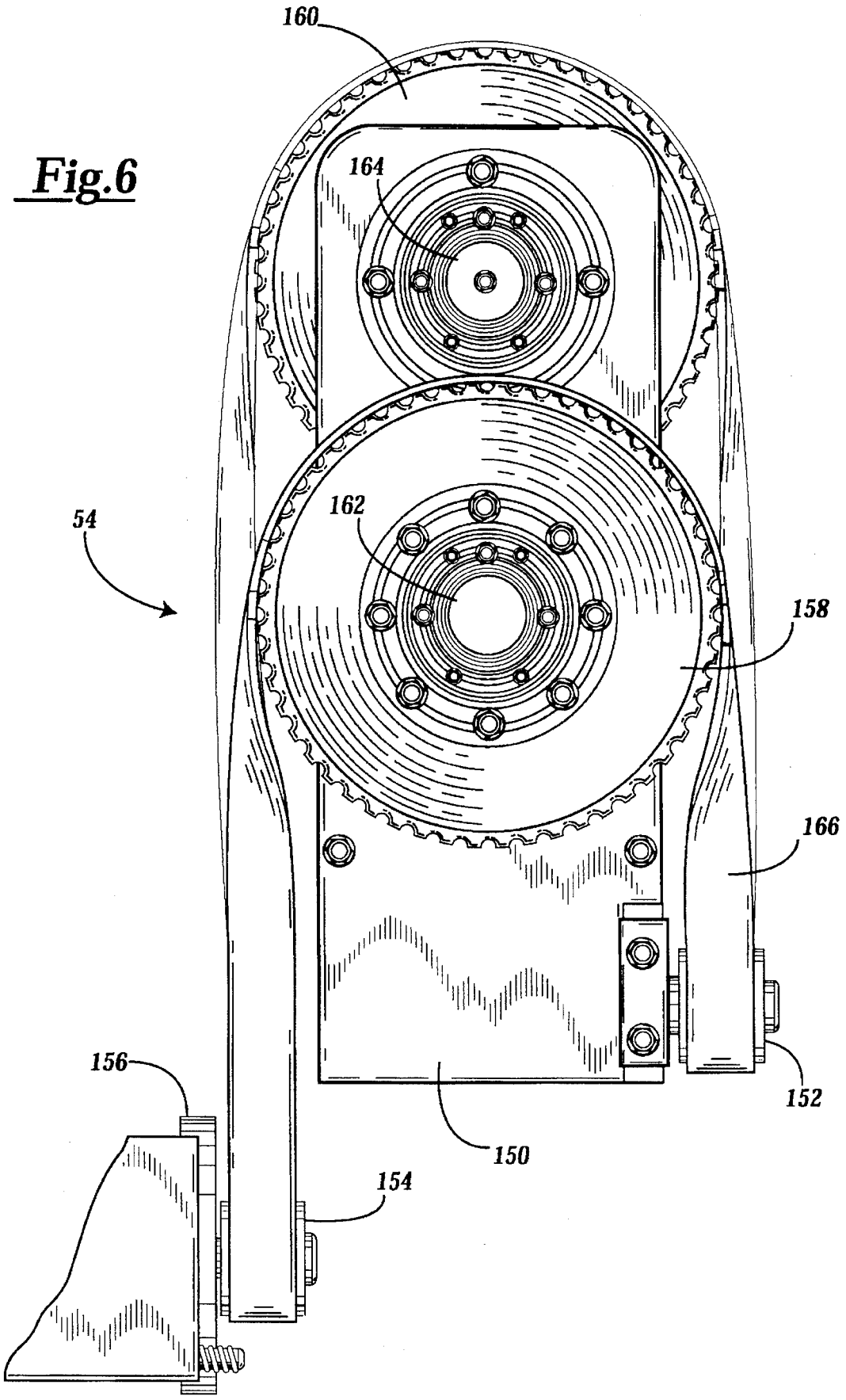
FIG. 6 is a end view of the drive associated with the present invention.

The rotary cutting/sealing shafts 40 and 42 are driven by twisted timing belt drive 54 shown in FIGS. 2 and 6. The timing belt drive arrangement comprises a frame 150 on which is journaled a small diameter pulleys 152. Small diameter pulley 154 is driven by a dc motor 156 and small diameter pulley 152 operates as an idler pulley. A pair of large diameter pulleys 158 and 160 are located on separate axes of stub shafts 162 and 164, respectively, both extending transverse to the axes of the small pulleys 152 and 154. The large diameter pulleys 158 and 160 are driven as idler pulleys.

A continuous timing belt 166 having regularly spaced teeth thereon is deployed over the four pulleys and with this arrangement a maximum number of teeth always engage each of the pulleys. More particularly, the drive pulley 154 and idler pulley 152 and driven pulleys 158 and 160 have 180 degrees of belt wrap about them. The 180 degrees of belt coverage on each pulley is achieved by spacing the two small diameter pulleys 152 and 154 apart on common or spaced apart parallel axes by a distance equal to the diameter of the large pulleys 158 or 160. The 180 degree of belt wrap coverage permits more horsepower to be delivered to the driven pulleys without tearing off teeth from the timing belt and allowing reduction rates. This arrangement offers the further advantage that the belt can be removed without requiring tools. Also, it is possible to reverse the direction of the drive by merely reversing the direction of rotation of the motor driven small diameter pulley.

Two driven u-joint shafts 56 and 58 are deposed between the twisted timing belt drive arrangement 54 and the cutting/sealing head shafts 40 and 42. The driven u-joint shaft 56 has a first u-joint 168 on a first end coupled to the stub shaft 164 of the large diameter pulley 160 on the timing belt drive assembly 54, as seen in FIG. 2. A second u-joint 170, located on a second end of the shaft 56, is operably coupled to the bearing block 46 in order to drive the cutting/sealing shaft 40 journaled for rotation therein. Likewise, driven u-joint shaft 58 has a u-joint 172 located on first end coupled to the stub shaft 162 of timing belt drive assembly 54. A second u-joint 172 of the shaft 58 is operably coupled to the bearing block 50 in order to drive the cutting/sealing shaft 42 journaled for rotation therein.

For operation, the modular cutting/sealing head units 17 and 18 must first be adjusted to the proper height with respect to the position of the packaging material tube as it will be routed in the cutting and sealing area. This is accomplished by rotating shaft 106, at its head 176, which is coupled to the height adjustment screws 70 and 102. The carriages 68 and 98 will be raised or lowered simultaneously depending on the direction of rotation of shaft 106.

The modular head units are inserted into their respective carriages to obtain the desired arrangement based on the crimper configuration, the cutting/sealing head shaft diameter and the product being packaged. Because the cutting/sealing head shafts 40 and 42 are offset from the central axis of the bearing blocks 44, 46, 48 and 50, different spacing between the modular cutting head units can be obtained by orienting the blocks as shown in FIGS. *5a–5c*. In FIG. *5a*, the modular cutting heads are oriented for the smallest distance between the cutting shafts. On bearing block 46, wedge retaining plate 86 is secured to end 138 which is closest to shaft 40 and spring 94 is received in counterbore 92 on end 140. On block 50, wedge retaining plate 80 is secured to end 126 which is closest to shaft 42 and spring 74 is received in counterbore 76 on end 128.

In FIG. *5b*, an intermediate spacing of the modular cutting/sealing heads is shown. Modular cutting head 17 is oriented so bearing block 46 has the orientation shown. Wedge retaining plate 86 is secured to end 140 on bearing block 46 which is further from shaft 40 than bearing block end 138. Spring 94 is received in counterbore 136 on bearing block end 138. Bearing block 50 has the same position shown in FIG. *5a*. Its wedge retaining plate 80 is secured to end 126 and spring 74 is received in counterbore 76 on end 128.

In FIG. *5c*, the farthest spacing between the two modular cutting/sealing heads is shown. Both modular cutting heads are oriented so that the bearing blocks 46 and 50 have the position shown in FIG. *5c*. On bearing block 46 wedge retaining plate 86 is secured to bearing block end 140 which is further from shaft 40 than bearing block end 138. Spring 94 is received in counterbore 136 on bearing block end 138. On bearing block 50 wedge retaining plate 80 is secured to bearing block end 128 and spring 74 is received in counterbore 130 on bearing block end 126.

The various positions are obtained by removing the carriage end plate 96 or 120 and sliding the bearing blocks out to be reoriented or replaced with a modular cutting/sealing head shaft having the desired crimper configuration or shaft diameter. As illustrated in FIG. 4, end plate 96 is removed and block 46 is slid out of the carriage. In the same manner, end plate 120 is removed from carriage 98 and bearing block 44 is slid out. If blocks 50 and 48 are to be reoriented or replaced with a different modular cutting/sealing shaft unit, endplates 72 and 100 are removed so blocks 48 and 50 may be slid out. The modular cutting/sealing heads to be used are then oriented and the wedge retaining plates are placed on the desired bearing block ends to achieve one of the three orientations shown in FIGS. *5a–c*. The bearing blocks are then inserted into the carriage 96 and 98, making sure that the wedges 84 and 112 received in the recesses of the wedge retaining plates and the springs 74, 94, 104 and 118 are received in the proper counterbore. The end plates are then fastened to the carriage walls.

Next, the tension must be set in the springs 74, 94, 104 and 118 coupled to the bearing blocks 44, 46, 48 and 50. The tensioned springs hold the bearing blocks in operating position against the wedges 84 and 112. The tensioned springs also allow the cutting heads to be deflected if the cutting blade 41 and anvil 43 meet product instead of just packaging material. In other words, if the force needed to cut through the product is too great, the blocks move against the springs. At the same time, the modular cutting/sealing head units must be seated against the wedge so that they operate in a uniform position. Accordingly, the spring tension should be the same in all the springs. The springs are adjusted by rotating their respective nuts shown as 131, 134, 137 and 144 in FIG. 3. The scales 146 and 148 assist the operator in determining that the springs are equally adjusted by allowing the operator to compare the length of the springs. Once the cutting/sealing head shafts 40 and 42 are properly adjusted and springs are properly tensioned, the cutting and sealing operation can begin.

The cutting/sealing head shafts 40 and 42 rotate in opposite angular directions to meet and engage the packaging film tube 16 at the appropriate location between the products 14 until they encounter a misoriented product. The bearing blocks 44, 46, 48 and 50 are in tension with the springs 74, 94, 104, 118 and when the cutting blade 41 and anvil 43 meet and engage the packaging film tube 16, the force needed to cut the film tube is negligible. However, if the cutting blade 41 and anvil 43 meet and engage product 14 the force needed to cut the product is too great. This causes the cutting blade and anvil to deflect the bearing blocks 44, 46, 48 and 50 along with shafts 40 and 42. The springs 74, 94, 104, and 118 must be appropriately adjusted via their retaining nuts 130, 131, 136 and 137 for achieving the desired force based on the product being packaged.

The u-joint shafts 56 and 58 allow the cutting/sealing head shafts 40 and 42 to separate without disrupting the twisted timing belt drive operation. The u-joint driven shafts 56 and 58 also enable the torsional forces to be uniform throughout the cutting/sealing head shafts 40 and 42. Thus, in the event the blade 41 and anvil 43 contact product 14 instead of packaging film 12, each cutting/sealing head shaft 40 and 42 deflects away from the cutting area instead of attempting to cut and seal the product because the force needed to cut through the product is too great. The misoriented product is not disturbed. The cutting/sealing head shafts then return to their proper operating position and cutting continues. The effect of the deflection is to minimize the further misorientation of products in line and to prevent the wrapping material from becoming dislodged from the finwheels and film former.

While the above provides a full and complete disclosure of the preferred embodiment of the present invention, various modifications, alternate constructions, and equivalents will occur to those skilled in the art given the benefit of this disclosure, thus, the invention is not to the specific embodiment described herein, but as defined by the appended claims.

What is claimed:

1. A cut/seal head apparatus for use in high speed wrapping and packaging machines comprising:

(a) a frame having first and second parallel, spaced-apart channels;

(b) first and second pairs of bearing blocks slidingly received in said first and second channels;

(c) a first cut/seal head shaft supporting a cut/seal head and having opposed ends journaled for rotation in the first pair of bearing blocks;

(d) a second cut/seal head shaft supporting a cut/seal head and having opposed ends journaled for rotation in the second pair of bearing blocks;

(e) biasing means cooperating between said frame and said first and second pairs of bearing blocks for normally biasing the first and second cut/seal head shafts toward one another; and (f) drive means for imparting rotational motion to the first and second cut/seal head shafts, the drive means including (i) a motor having an output shaft with a first belt pulley affixed to the output shaft:

(ii) subframe member having a pair of jack shafts journaled for rotation therein on parallel axis perpendicular to the motor output shaft at vertically offset locations said first and second jack shafts having second and third belt pulleys of equal size affixed individually to the first and second jack shafts:

(iii) a further jack shaft journaled for rotation on the subframe member on an axis parallel to the motor's output shaft, the further jack shaft having a fourth belt pulley equal in size to the first belt pulley:

(iv) an endless belt deployed about the first, second, third and fourth belt pulleys to drive the pair of jack shafts in opposite directions: and (v) U-joint coupling means extending between the pair of jack shafts and the first and second cut/seal shafts, the U-joint coupling means permitting both the first and second cut/seal head shafts to be displaced away from one another against a force imparted by the biasing means while continuing to be rotated.

2. A cut/seal head as in claim 1 wherein the bearing blocks of the first and second pairs each include six mutually perpendicular rectangular faces with a bearing receiving bore extending between two opposed faces thereof at a location that is closer to one edge of the two opposed faces than to an opposite edge of the same two opposed faces.

3. The cut/seal head assembly as in claim 2 and further including an adjustable stop means disposed in the first and second channels between the first and second pairs of bearing blocks for establishing a desired spacing between the first and second pairs of bearing blocks.

4. The cut/seal head apparatus as in claim 3 wherein both the first and second cut/seal head shafts are deflectable away from an initial position established by the stop means upon the cut/seal heads impinging upon a misaligned product passing between the cut/seal head.

5. The cut/seal head apparatus as in claim 1 wherein the U-joint coupling means includes a first shaft having a first U-joint coupled to one of the pair of jack shafts and a second U-joint coupled to the first cut/seal head shaft and a second shaft having a third U-joint coupled to the other of the pair of jack shafts and a fourth U-joint coupled to the second cut/seal head shaft.

6. The cut/seal head apparatus as in claim 1 wherein the tension of the biasing means is adjustable.

7. A cut/seal head apparatus for use in high speed wrapping and packaging machines comprising:

(a) a frame having first and second parallel, spaced-apart channels;

(b) first and second pairs of bearing blocks slidingly received in said first and second channels;

(c) a first cut/seal head shaft supporting a cut/seal head and having opposed ends journaled for rotation in the first pair of bearing blocks;

(d) a second cut/seal head shaft supporting a cut/seal head and having opposed ends journaled for rotation in the second pair of bearing blocks, said first and second cut/seal head shafts being rotatable independently of one another;

(e) biasing means cooperating between said frame and said first and second pairs of bearing blocks for normally biasing the first and second cut/seal head shafts toward one another; and (f) drive means for imparting rotational motion to the first and second cut/seal head shafts, the drive means including U-joint coupling means for permitting both the first and second cut/seal head shafts to be displaced away from one another against a force imparted by the biasing means while continuing to be rotated.

8. A cut/seal head as in claim 7 wherein the bearing blocks of the first and second pairs each include six mutually perpendicular rectangular faces with a bearing receiving bore extending between two opposed faces thereof at a location that is closer to one edge of the two opposed faces than to an opposite edge of the same two opposed faces.

9. The cut/seal head assembly as in claim 8 and further including an adjustable stop means disposed in the first and second channels between the first and second pairs of bearing blocks for establishing a desired spacing between the first and second pairs of bearing blocks.

10. The cut/seal head apparatus as in claim 7 wherein the drive means comprises, in combination:

(a) a motor having an output shaft with a first belt pulley affixed to the output shaft;

(b) a subframe member having a pair of jack shafts journaled for rotation therein on parallel axis perpendicular to the motor output shaft at vertically offset locations, said first and second jack shafts having second and third belt pulleys of equal size affixed individually to the first and second jack shafts;

(c) a further jack shaft journaled for rotation on the subframe member on an axis parallel to the motor's output shaft, the further jack shaft having a fourth belt pulley equal in size to the first belt pulley;

(d) an endless belt deployed about the first, second, third and fourth belt pulleys to drive the pair of jack shafts in opposite directions, the U-joint coupling means extending between the pair of jack shafts and the first and second cut/seal shafts.

11. The cut/seal head apparatus as in claim 9 wherein both the first and second cut/seal head shafts are deflectable away from an initial position established by the stop means upon the cut/seal heads impinging upon a misaligned product passing between the cut/seal head.

12. The cut/seal head apparatus as in claim 10 wherein the U-joint coupling means includes a first shaft having a first U-joint coupled to one of the pair of jack shafts and a second U-joint coupled to the first cut/seal head shaft and a second shaft having a third U-joint coupled to the other of the pair of jack shafts and a fourth U-joint coupled to the second cut/seal head shaft.

13. The cut/seal head apparatus as in claim 7 wherein the tension of the biasing means is adjustable.

* * * * *